United States Patent [19]

Siglock

[11] 4,258,295

[45] Mar. 24, 1981

[54] TIMED BALLAST CIRCUIT FOR SODIUM VAPOR LAMP

[75] Inventor: John V. Siglock, Sierra Madre, Calif.

[73] Assignee: Unicorn Electrical Products, Anaheim, Calif.

[21] Appl. No.: 91,539

[22] Filed: Nov. 5, 1979

[51] Int. Cl.[3] ..... H05B 41/231; H05B 41/36

[52] U.S. Cl. ..... 315/189; 315/193; 315/282; 315/323; 315/360

[58] Field of Search ..... 315/189, 193, 278, 279, 315/282, 323, 324, 360, 362, DIG. 5; 323/4, 6

[56] References Cited

U.S. PATENT DOCUMENTS

| | | | |
|---|---|---|---|
| 2,853,654 | 9/1958 | Swasey | 315/193 |
| 3,440,520 | 4/1969 | Jones et al. | 315/278 X |
| 3,609,515 | 9/1971 | Babcock et al. | 323/6 |
| 4,097,783 | 6/1978 | Hathaway | 315/323 |

*Primary Examiner*—LaRoche, Eugene R.
*Attorney, Agent, or Firm*—Christie, Parker & Hale

[57] ABSTRACT

A ballast circuit for driving a sodium vapor lamp includes a ballast transformer having a primary winding connected to a constant current power source. A secondary winding of the transformer is connected across the lamp. A high voltage oscillator responsive to the voltage across the lamp superimposes high voltage pulses across the lamp when the voltage across the lamp is above a predetermined level. A time delay circuit, triggered by the initial voltage across the primary winding when the power from the power source is turned on, opens a normally closed switch connected across the primary winding a predetermined time interval after the time delay circuit is triggered.

11 Claims, 3 Drawing Figures

TIMED BALLAST CIRCUIT FOR SODIUM VAPOR LAMP

FIELD OF THE INVENTION

This invention relates to ballast circuits for operating sodium vapor lamps, and more particularly, is concerned with a ballast circuit with a time delay for delaying the time the lamp starts after the power is turned on.

BACKGROUND OF THE INVENTION

Sodium vapor arc discharge lamps for use in street lighting, for example, are well known. Because the sodium ionizes at relatively high temperature, the lamps usually include a gas such as neon or xenon which ionizes readily and forms an inital arc. This arc is used to initially ionize mercury vapor and the arc from the mercury vapor in turn ionizes the sodium. The start-up process for a cold lamp is typically in the order of five minutes.

The high voltage potential necessary to initiate an arc in the low pressure gases of the sodium lamp is derived from a ballast transformer connected to a constant current power source. In a typical installation, the ballast transformers for a number of lamps are connected in series across a moving coil type constant current power transformer. Because the transformer secondary of the ballast transformers looks at a very high impedance load until the arc is struck in the lamp, the voltage across the primary and secondary of the ballast transformer is initially quite high. With the rise in voltage with constant current, the power input to each lamp is therefore at a peak during initial start. The constant current transformer must therefore have a volt-ampere rating that is approximately four times the rating required to operate the lamps after they reach steady state operating condition. Since it is desirable to operate as many lamps as possible off of one power transformer, the relatively large start-up power requirement becomes a limiting factor. If the starting of the lamps could be staggered so that only a portion of the lamps were in the start-up mode at one time, the rating of the constant current transformer could be reduced or more lamps could be used on the same capacity circuit.

One solution which has been heretofore proposed is to provide a timed switch in association with a lamp which initially short circuits the primary of the ballast transformer and provides a shunt current path for the constant current from the power transformer. By opening the switches at delayed time intervals, groups of lamps could be activated at staggered time intervals. Several problems have limited the usefulness of such an approach. While mechanical contacts are used for the switches, because each set of contacts must handle the full current capacity of the system, contact life is quite limited and maintenance is difficult and expensive. Moreover, with shorting of the primary no voltage potential exists at the ballast unit to power a timing circuit. Mechanical or battery powered timers have been used but also present a maintenance problem.

SUMMARY OF THE INVENTION

The present invention is directed to an improved ballast circuit for operating a sodium vapor lamp that incorporates a start delay control that shorts out the ballast transformer for a controlled interval after the power source is turned on. By providing the individual lamps (or group of lamps) in the series loop with different delay times, the initial start-up load can be substantially minimized and the ratio of peak capacity to steady-state operating capacity of the constant current transformer for a multiple lamp system substantially reduced. The delay control uses solid state switching and uses power derived from the constant current source. A solid state timing circuit associated with each ballast can be preset to provide integral time delay multiples of 1 to 15 minutes. The ballast is self-contained, easily installed and, because it is entirely solid state, is virtually maintenance-free.

These and other advantages are achieved, in brief, by a ballast circuit including a ballast transformer having a primary connected in series with a constant current power source and a secondary connected across a sodium vapor arc discharge lamp. An adjustable time-delay circuit is also connected across a portion of the secondary transformer whose primary is in series with the constant current source. A solid state switch shunts a portion of the primary, reducing the power input to the ballast to less than the power needed to operate the lamp. After a predetermined time interval after the power source is turned on, the time-delay circuit opens the solid state switch, providing full start-up power to the lamp. The resulting increase in voltage across the secondary turns on a high voltage oscillator for pulsing the lamp to initiate an arc and the start-up process.

BRIEF DESCRIPTION OF THE DRAWINGS

For a more complete understanding of the invention reference should be made to the accompanying drawings, wherein.

DETAILED DESCRIPTION

Figure 1:
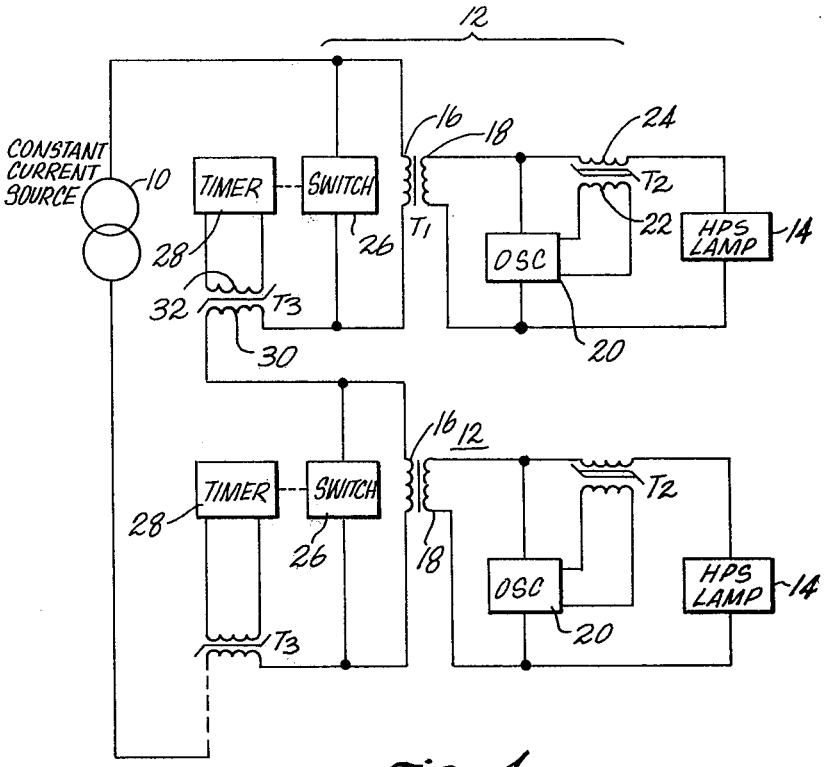
FIG. 1 is a schematic block diagram of a lighting system incorporating the invention.

Referring to FIG. 1 in detail, there is shown a high-pressure sodium lamp lighting system driven from a constant current AC power source, indicated generally at 10. Conventionally the constant current power source is a moving coil transformer. The output of the transformer provides power to a plurality of lamp units consisting of a ballast control 12 and a high-pressure sodium lamp 14, the ballast controls being connected in series across the output of the constant current source 10. Each ballast control circuit 12 includes a ballast transformer $T_1$ having a primary winding 16 connected in series with the primary windings of the other ballast controls in the series loop. The ballast transformer includes a secondary winding 18 which is connected across the associated lamp 14.

Each ballast control circuit includes a high voltage oscillator 20 connected across the secondary winding 18 which generates high voltage output pulses which are applied across the lamp 14 through a ferrite core transformer $T_2$ having a primary winding 22 connected across the output of the oscillator 20 and a secondary winding 24 connected in series with the secondary winding 18. As described in detail in connection with FIG. 2, the high voltage oscillator 20, in response to a voltage level across the secondary winding 18 before an arc is formed across the lamp 14, generates high voltage pulses which ionize the low pressure gas in the lamp to initiate an arc discharge.

Figure 2:
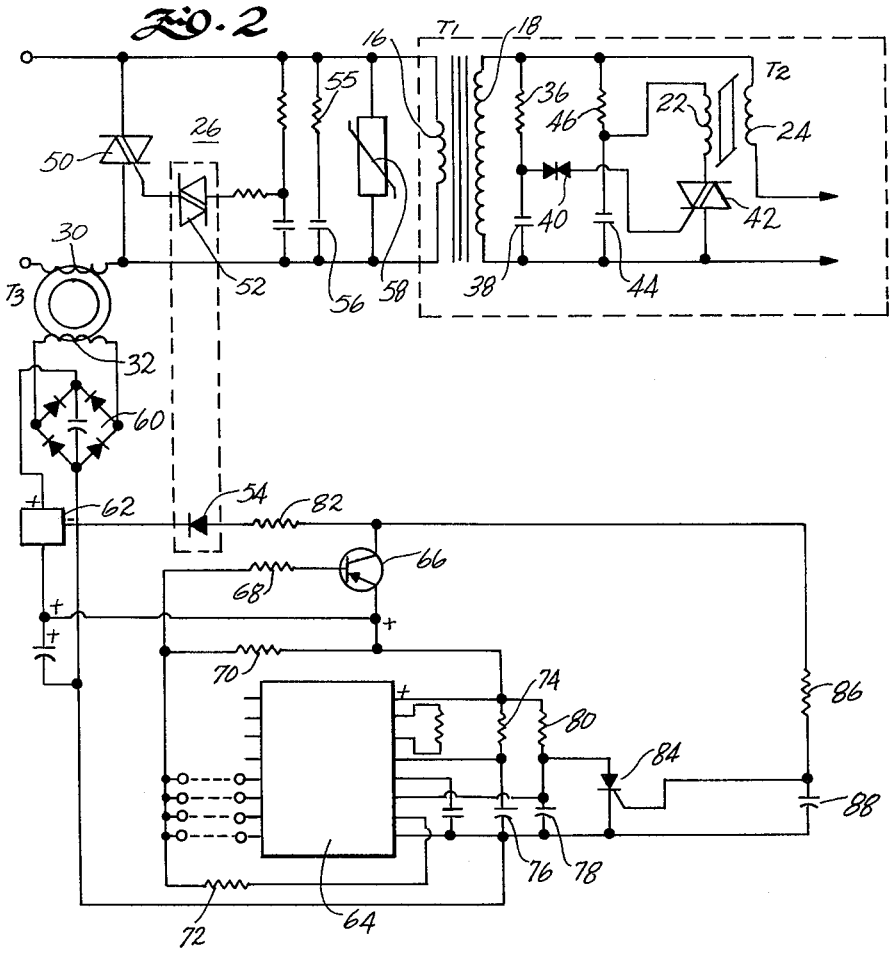
FIG. 2 is a schematic circuit diagram of the ballast control circuit of the present invention.

A normally closed solid state switch 26 is connected in shunt across the primary winding 16. The switch, as described below in connection with FIG. 2, provides a very low impedance shunting the turns of the primary winding 16 when the switch is closed. The switch is controlled by a timing circuit 28 energized from a transformer $T_3$ having its primary winding 30 connected in series with the constant current source and its secondary winding 32 connected to the timer circuit 28.

Referring to the detailed schematic circuit diagram of FIG. 2, the ballast circuit for the high-pressure sodium lamp includes an R-C charging circuit including resistor 36 and capacitor 38. When the lamp is being started, a large voltage across the secondary 18 charges the capacitor 38 to a potential high enough to cause a diac 40, to conduct, gating on a triac 42. The triac discharges a capacitor 44, charged through a resistor 46, through the primary winding 22 of the transformer $T_2$. The resistor 46 is large enough to limit current below the holding level for the triac 42. The discharge pulse is amplified by the turns ratio of the transformer $T_2$ to produce a high-voltage pulse which is applied to the lamp 14 with each half cycle of the AC power source. The voltage pulses ionize the xenon starting gas, elevating both temperature and pressure in the lamp and ultimately resulting in sodium ionization of the lamp. Once the sodium arc is formed, the low impedance load causes the voltages across the primary and secondary of the transformer $T_1$ to drop. The drop in voltage stops operation of the oscillator.

In order to stagger the start-up process of the lamps, the switch 26 across the primary of the transformer $T_1$ shunts the current through the primary winding 16 of the transformer $T_1$ for a period of time determined by the timer 28. As shown in detail in FIG. 2, the switch 26 includes triac 50 connected in parallel across the primary winding 16. The triac 50 is gated by a photodiac 52 which in turn is triggered by light from a light-emitting diode 54 controlled by the timing circuit 28. The series R-C network, including resistor 55 and capacitor 56, is connected across the triac 50 to prevent false triggering of the triac from transients produced by the inductive load of the transformer. A conventional voltage limiting element 58 clamps line voltage transients that could damage the triac.

The transformer $T_3$ provides power for the timing circuit 28 through a bridge rectifier 60 and a voltage regulator 62, which for example, may be a commercially available type 7805 integrated circuit. The timer circuit includes a type 2240 integrated circuit timer 64. The timer includes an oscillator section followed by a counter section. The timing period of the counter is externally programmable by shunt connections to pins #5, #6, #7 and #8 which connect the base of a transistor 66 through a resistor 68 and to the plus voltage supply through a resistor 70. The shunt connections to the counter are also connected to the reset pin #10 of the timer integrated circuit through a resistor 72. The oscillator section is controlled in frequency by an R-C network, including a resistor 74 and capacitor 76. The time constant of the resistor and capacitor are chosen to provide a basic one pulse per 3.52 seconds, thus providing a timing interval of one minute at pin #5, two minutes at pin #6, four minutes at pin #7, and eight minutes at pin #8 from the counter. Thus any combination of the shunts can provide timing from zero to fifteen minutes in one-minute increments.

The timer is triggered initially by the charging of a capacitor 78 through resistor 80 when power is turned on to the system. During the timing interval, the output from the pins 5–8 causes the transistor 66 to be turned on providing a flow of current through a resistor 82 and light-emitting diode 54, thus turning on the triac switch 50 and shunting the primary winding 16 of the transformer $T_1$. After the selected time-out interval, the voltage at the pins 5–8 goes positive, turning off the transistor 66 and resetting the timer through the resistor 72. To prevent further timing cycles until power is removed, an SCR 84 is gated on shorting the capacitor 78 and removing the trigger input from the timer. The SCR is gated on a delayed time after power is applied, the delayed time being determined by the R-C circuit including resistor 86 and capacitor 88.

From the above description it will be recognized that a timing arrangement is provided by which the start-up process of each of the high-pressure sodium lamps in the lighting circuit can be controlled so that all of the lights in the circuit do not start up at the same time. By staggering the times at which individual lights or groups of lights are turned on, the load on the power transformer can be controlled.

Figure 3:
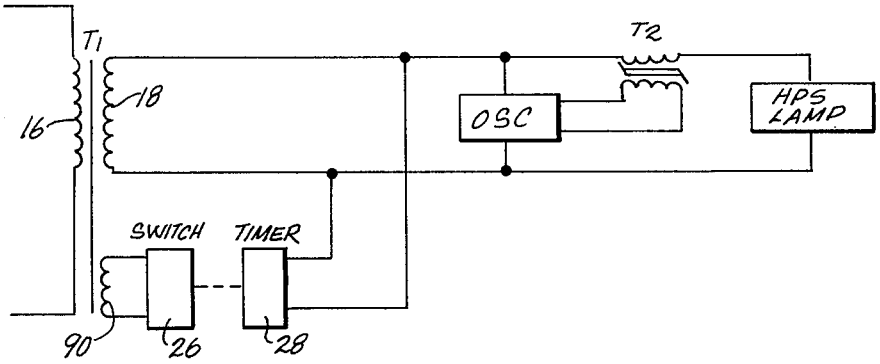
FIG. 3 is an alternative embodiment of the invention.

An alternative arrangement is shown in FIG. 3 in which the switch 26 instead of directly shunting the primary winding 16, is used to shunt a tertiary winding 90 on the transformer $T_1$. The voltage for the timing circuit 28 may be derived from the secondary winding 18. When the switch 26 shorts out the tertiary winding 90 it reflects a very low impedance load across the primary, reducing the power input to the ballast to a level less than the power needed to operate the lamp. However, sufficient power is still available to operate the time delay circuit. This arrangement reduces the peak voltage across the switch 26, allowing lower rated and less expensive switch elements to be used.

What is claimed is:

1. A ballast circuit for operating a sodium vapor lamp from a constant current alternating voltage source comprising: a ballast transformer having a primary winding connected to said source and secondary winding connected across the lamp, a high voltage pulsing circuit connected across the secondary winding for pulsing the lamp when the voltage across the secondary winding is above a predetermined level, a switching element for connecting a low resistance load across the primary winding, means for closing the switching element when voltage is initially applied to the primary of the ballast transformer from said voltage source, and timing means for opening the switching element after a predetermined time interval.

2. Apparatus of claim 1 wherein the timing circuit includes means deriving a DC voltage from the constant current source, and means responsive to the turning on of said DC voltage for activating said means for closing the switching element, and means responsive to the turning off of said DC voltage for resetting the timing circuit.

3. Apparatus of claim 1 wherein the switching element includes a triac, a photo-diac for gating the triac on and off, and a light emitting diode for optically triggering the photo-diac, the diode normally being biased on to emit light by the timing circuit during said predetermined time interval and being biased off by the timing circuit at the end of said predetermined time interval.

4. Apparatus of claim 2 wherein the switching element includes a triac, a photo-diac for gating the triac on and off, and a light emitting diode for optically triggering the photo-diac, the diode normally being biased on to emit light by the timing circuit during said predetermined time interval and being biased off by the timing circuit at the end of said predetermined time interval.

5. Apparatus of claim 4 wherein the means deriving a DC voltage includes a rectifier means, and a second transformer having a primary winding connected in series with the primary winding of the ballast transformer and secondary winding connected across the rectifier means.

6. Apparatus of claim 1 wherein the pulsing circuit includes an oscillator connected across the secondary of the ballast transformer, and a pulsing transformer having a primary winding connected to the oscillator and a secondary winding in series with the lamp.

7. Apparatus of claim 6 wherein the pulsing transformer has a ferrite core.

8. Apparatus of claim 5 wherein the pulsing circuit includes an oscillator connected across the secondary of the ballast transformer, and a pulsing transformer having a primary winding connected to the oscillator and a secondary winding in series with the lamp.

9. Apparatus of claim 8 wherein the pulsing transformer has a ferrite core.

10. A lighting system comprising: a constant current alternating voltage source, a plurality of high-pressure sodium lamps, a ballast circuit connected to each lamp, the ballast circuits for all the lamps being connected in series across said source, each ballast circuit including a ballast transformer having a primary winding connected in series circuit with the primary windings of the other ballast transformers across said source and a secondary winding connected across one of said lamps, a solid state switching element connected in parallel across the primary winding, and a timing circuit energized from said source for closing said solid state switch for a predetermined time interval following the energizing from said source.

11. Apparatus of claim 10 wherein the solid state switch in each of the ballast circuits includes a triac, a photo diac for gating the triac, and a light emitting diode illuminating the photodiac, the diode being controlled by said timing circuit.

* * * * *